US008230529B1

(12) United States Patent
Reid

(10) Patent No.: US 8,230,529 B1
(45) Date of Patent: Jul. 31, 2012

(54) TOILET SEAT LIFTING APPARATUS

(76) Inventor: Michael D. Reid, Brookwood, AL (US)

( * ) Notice: Subject to any disclaimer, the term of this patent is extended or adjusted under 35 U.S.C. 154(b) by 92 days.

(21) Appl. No.: 12/917,251

(22) Filed: Nov. 1, 2010

(51) Int. Cl.
*A47K 13/10* (2006.01)

(52) U.S. Cl. ..... 4/246.3; 4/246.4; 4/246.5

(58) Field of Classification Search ..... 4/246.1, 4/246.3–246.5
See application file for complete search history.

(56) References Cited

U.S. PATENT DOCUMENTS 4,649,576 A 3/1987 Lillie
5,075,906 A 12/1991 Robbins
6,189,160 B1 2/2001 Pettus
6,470,503 B1 10/2002 Holmes
6,588,027 B1 7/2003 Bowden et al.
7,254,846 B2 * 8/2007 Kim ..... 4/246.3

* cited by examiner

*Primary Examiner* — Tuan N Nguyen

(57) ABSTRACT

The toilet seat lifting apparatus lifts a toilet seat with a user's foot. The apparatus is omnidirectional, so it can be easily reversed to operate on either side of a toilet. Almost any toilet is fitted, without modification. The base does not require mounting but instead is rested upon a surface adjacent to a toilet. The semicircular base importantly covers the pivot pedestal and the pivotally attached lever, so that splash is not a concern, yet the removable side cover allows maintenance, such as lubrication. As the hinge rod and seat arm are of relatively small diameter, and as both are adjacent to the back of the seat, less obtrusive appearance is a benefit, as is avoidance of urine stream incursion.

3 Claims, 6 Drawing Sheets

TOILET SEAT LIFTING APPARATUS

CROSS-REFERENCE TO RELATED APPLICATIONS

Not Applicable

FEDERALLY SPONSORED RESEARCH OR DEVELOPMENT

Not Applicable

INCORPORATION BY REFERENCE OF MATERIAL SUBMITTED ON A COMPACT DISK

Not Applicable

BACKGROUND OF THE INVENTION

Reasons for wanting to lift a toilet seat without using one's hands are well understood. To that end, a plethora of devices have been proposed, each with unique variations that hopefully solve the myriad of problems associated with such devices. Some seat lifting devices are mechanical while others have resorted to electrical operation and hydraulic operation. Among the mechanical seat lifting devices, many are often simply too complex. Some do not allow sufficient height adjustment to fit a variety of toilets. Some do not offer proper leverage for a user to "feel" what his/her foot is doing, and thereby either bang the seat up or down or fail to lift the seat sufficiently. Some devices require toilet modifications. Another problem has been that many devices are more proximal to a urine stream, and therefore suffer the hygiene and maintenance problems associated therewith. The present apparatus offers a straight-forward mechanical means for easily lifting a toilet seat, without modification to any part of the toilet or seat.

The basic structure and ease of maintenance provides for long trouble-free life, key concerns in what is a harsh, corrosive environment.

FIELD OF THE INVENTION

The toilet seat lifting apparatus relates to toilets and more especially to a mechanical seat lifting apparatus that is foot operated.

SUMMARY OF THE INVENTION

The general purpose of the toilet seat lifting apparatus, described subsequently in greater detail, is to provide a toilet seat lifting apparatus which has many novel features that result in an improved toilet seat lifting apparatus which is not anticipated, rendered obvious, suggested, or even implied by prior art, either alone or in combination thereof.

To attain this, the toilet seat lifting apparatus lifts a toilet seat without having to touch the seat. Instead, a user's foot does the lifting. The apparatus is omnidirectional, so it can be easily reversed to operate on either side of a toilet. Almost any toilet is fitted, without modification. The base does not require mounting but instead is rested upon a surface adjacent to a toilet. The semicircular base importantly covers the pivot pedestals and lever pedestals so that splash is not a concern, yet the removable side cover allows maintenance, such as lubrication and cleaning.

While the basic embodiment uses a straight lever, the most complete embodiment uses a lever with bends to more easily accommodate toilet seat bottom lift with optimal leverage and foot placement afforded by the more horizontally disposed pedal, as compared to the more basic embodiment. As the hinge rod and seat arm are of relatively small diameter, and as both are adjacent to the back of the seat, less obtrusive appearance is a benefit. Importantly, the entire mechanical design of the apparatus is experimentally determined to be most advantageous in providing a feel for foot operation, allowing a user to easily determine the pressure needed to properly lift the seat and to easily lower the seat without slamming.

The apparatus is provided in more than one material makeup, with stainless steel, plasticized components, composites, and alloys being preferred. The apparatus provides height adjustability for adaptation to a variety of toilet seat heights via the two-piece vertical arm.

Thus has been broadly outlined the more important features of the improved toilet seat lifting apparatus so that the detailed description thereof that follows may be better understood and in order that the present contribution to the art may be better appreciated.

An object of the toilet seat lifting apparatus is to lift a toilet seat without having to touch the seat.

Another object of the toilet seat lifting apparatus is to lift a toilet seat with one's foot.

A further object of the toilet seat lifting apparatus is to provide a sturdy apparatus for lifting a toilet seat.

An added object of the toilet seat lifting apparatus is to provide height adjustability for adaptation to a variety of toilet seat heights.

And, an object of the toilet seat lifting apparatus is to provide easy access for any maintenance.

A further object of the toilet seat lifting apparatus is to affix to virtually any given toilet without toilet modification.

These together with additional objects, features and advantages of the improved toilet seat lifting apparatus will be readily apparent to those of ordinary skill in the art upon reading the following detailed description of presently preferred, but nonetheless illustrative, embodiments of the improved toilet seat lifting apparatus when taken in conjunction with the accompanying drawings.

In this respect, before explaining the current embodiments of the improved toilet seat lifting apparatus in detail, it is to be understood that the toilet seat lifting apparatus is not limited in its application to the details of construction and arrangements of the components set forth in the following description or illustration. Those skilled in the art will appreciate that the concept of this disclosure may be readily utilized as a basis for the design of other structures, methods, and systems for carrying out the several purposes of the improved toilet seat lifting apparatus. It is therefore important that the claims be regarded as including such equivalent constructions insofar as they do not depart from the spirit and scope of the toilet seat lifting apparatus. It is also to be understood that the phraseology and terminology employed herein are for purposes of description and should not be regarded as limiting.

DETAILED DESCRIPTION OF THE DRAWINGS

With reference now to the drawings, and in particular FIGS. 1 through 8 thereof, the principles and concepts of the toilet seat lifting apparatus generally designated by the reference number 10 will be described.

Figure 1:
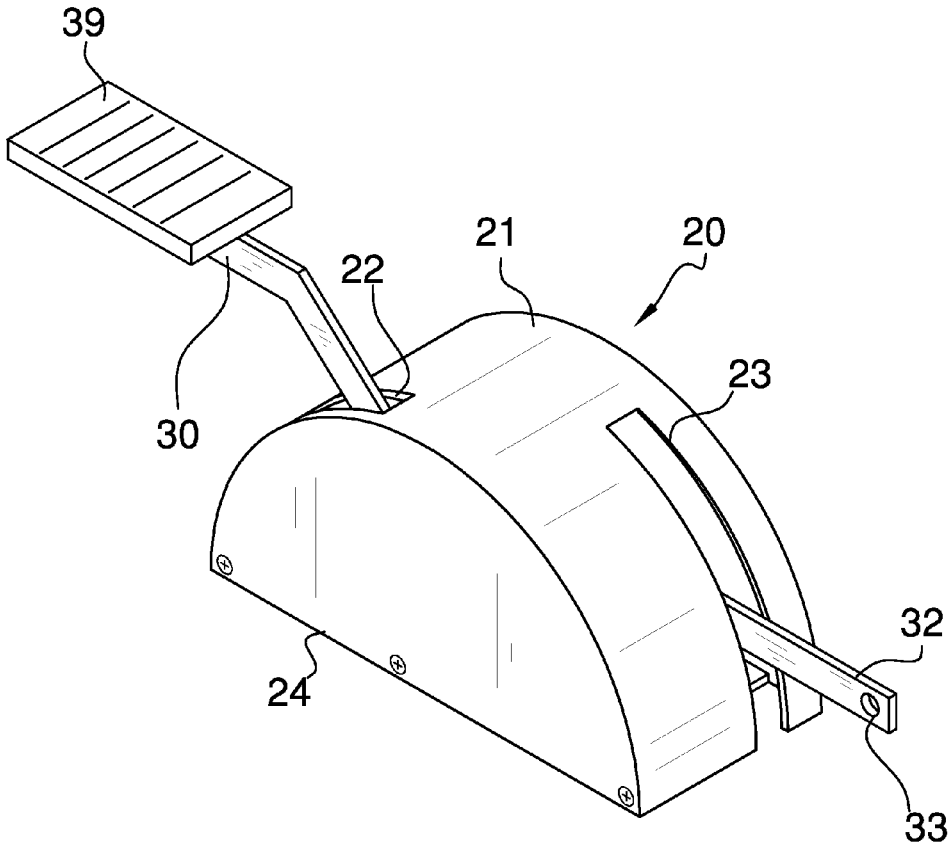
FIG. 1 is a perspective view of the semicircular base with levers.
Figure 6:
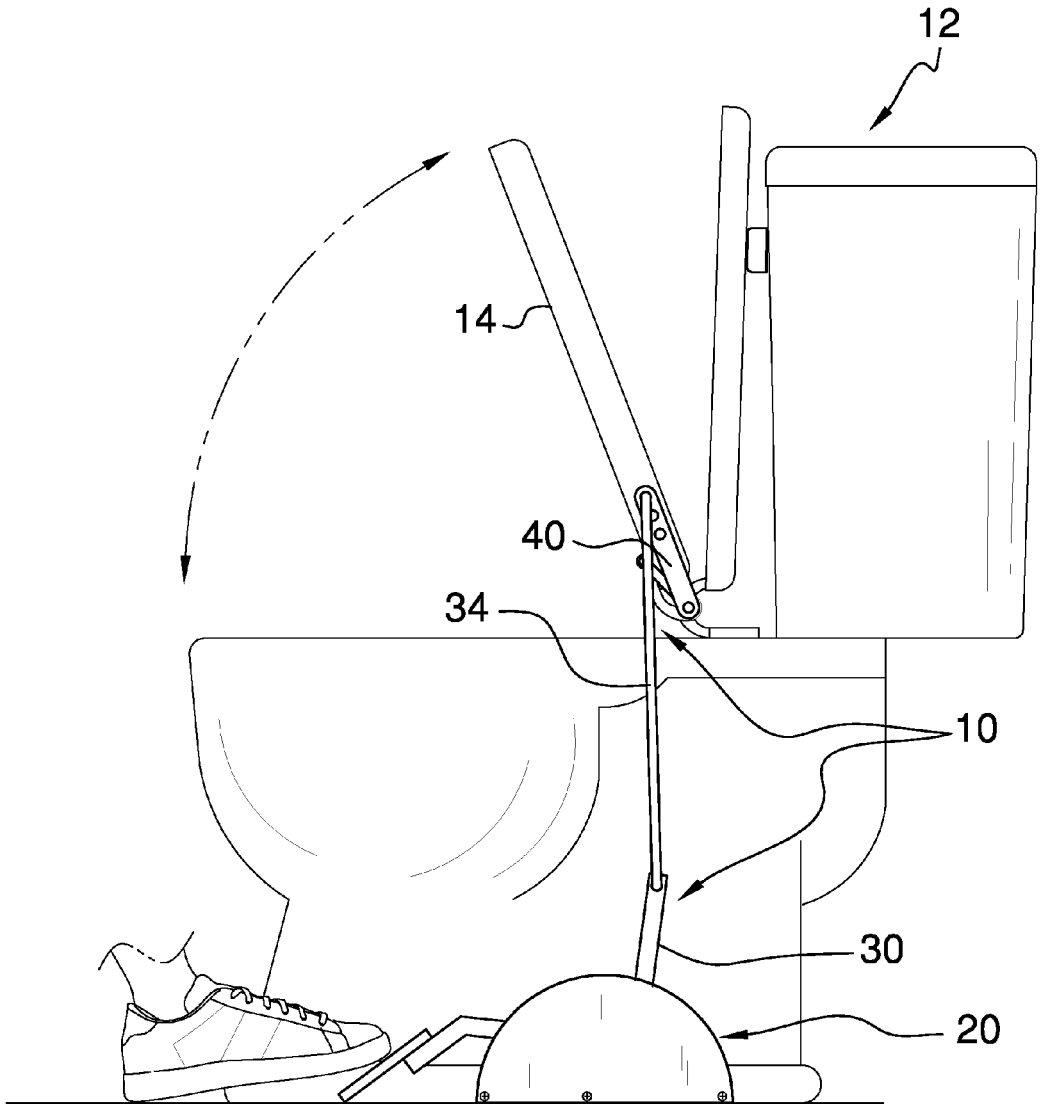
FIG. 6 is a lateral elevation view of the apparatus installed on an existing toilet seat.

Referring to FIGS. 1 and 6, the apparatus 10 partially comprises the semicircular base 20 with base top 21 having the lever 30 and flat lever 43 partially extended therefrom.

Figure 2:
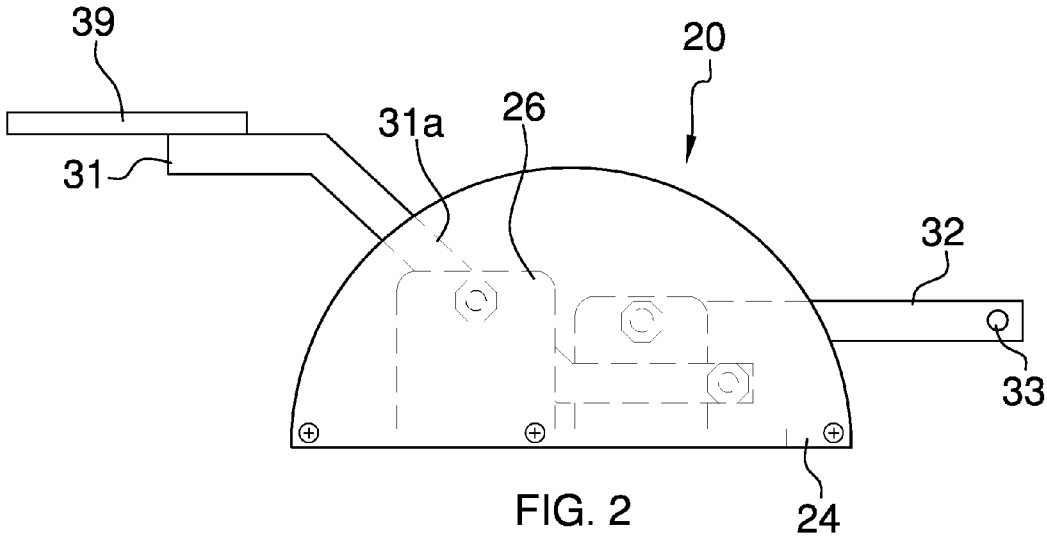
FIG. 2 is a lateral side elevation view of the base with levers.

Continuing to refer to FIG. 1 and referring to also to FIG. 2, the apparatus 10 base 20 further comprises the base top 21 disposed atop the base plate 21*a*.

Figure 7:
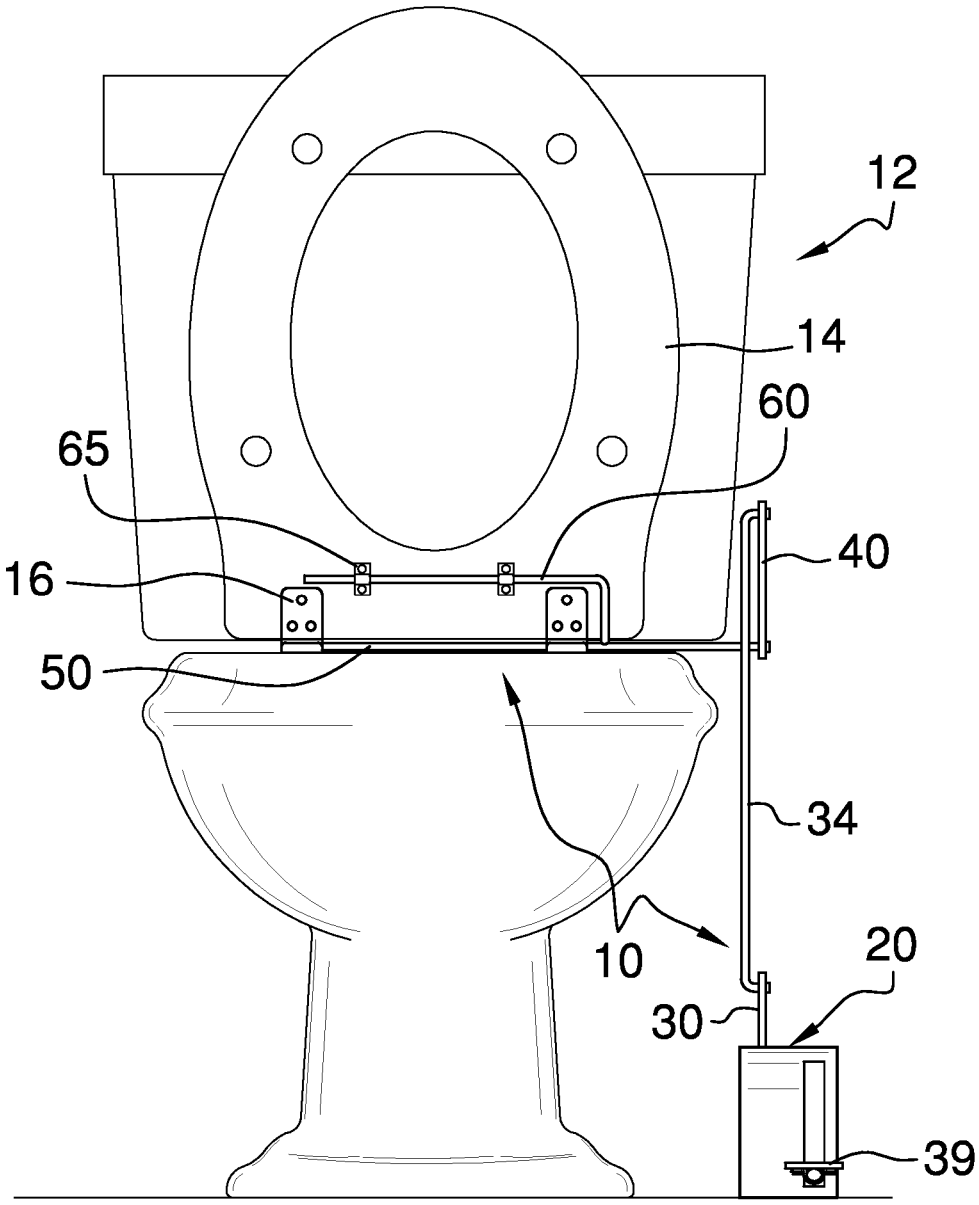
FIG. 7 is a front elevation view of the apparatus installed on an existing toilet.

Referring to FIGS. 6 and 7, the base plate 21*a* is selectively placed upon an existing given surface next to an existing toilet 12.

Referring again to FIGS. 1 and 2, the removable side cover 24 is disposed laterally on the base 20 and is removably connected to the base top 21. The first slot 22 is disposed forwardly and laterally in the base top 21. The second slot 23 is disposed rearwardly and medially in the base top 21.

Figure 3:
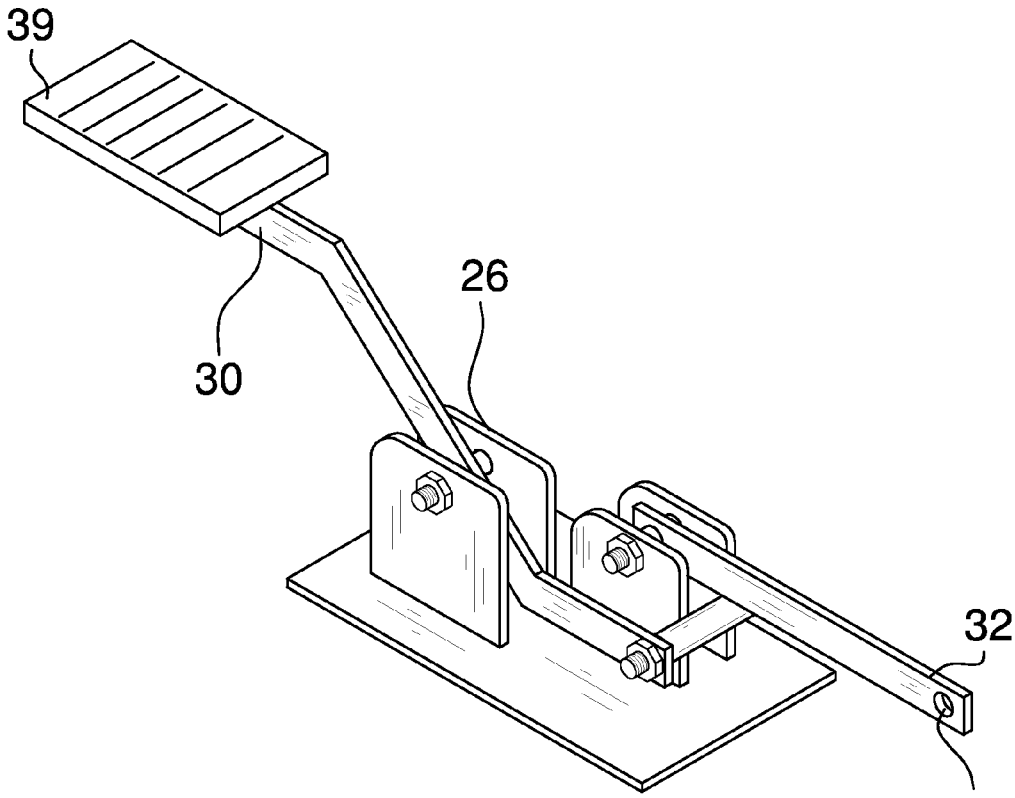
FIG. 3 is a perspective view of the base plate with levers.
Figure 4:
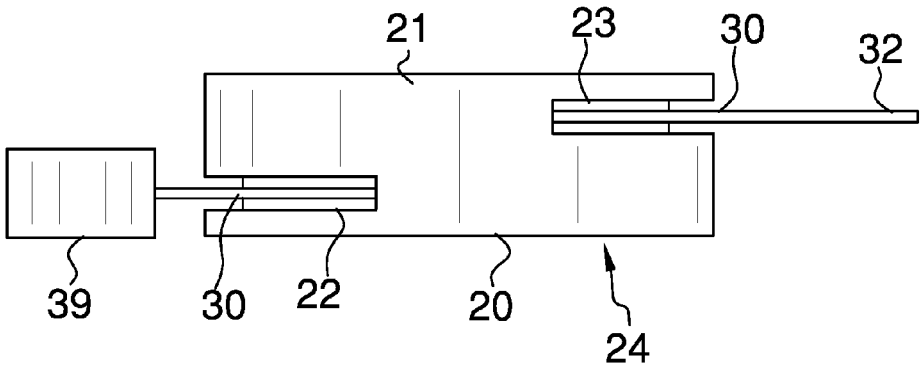
FIG. 4 is a top plan view of the base with levers extended therebeyond.

Referring to FIG. 3, the pair of identical spaced apart pedestals is disposed forwardly and vertically atop the base plate 21*a*. The pedestals comprise the first pedestal 26 disposed parallel to the second pedestal 27. The first pivot bolt with nut 46 upwardly and horizontally connects the first pedestal 26 to the second pedestal 27. The lever 30 has a first end 31 spaced apart from the second end 32. The lever 30 is movably fitted within the first slot 22. The downward bend 31*a* is disposed most proximal to the lever 30 first end 31. The upward bend 32*a* is disposed most proximal to the lever 30 second end 32. The lever 30 is pivotally connected to the first pivot bolt with nut 46 between the downward bend 31*a* and the upward bend 32*a*. The roller 48 is removably attached horizontally and medially to the lever 30 second end 32. The pair of spaced apart lever pedestals is disposed vertically, medially and rearwardly on the base plate 21*a*. The lever pedestals comprise the first level pedestal 28 disposed parallel to the second lever pedestal 29. The second pivot bolt with nut 47 horizontally and upwardly connects the first lever pedestal 28 to the second lever pedestal 29.

The flat lever 43 has a lever first end 43*a* spaced apart from the lever second end 43*b*. The lever first end 43*a* is pivotally connected to the second pivot bolt with nut 47 via the first orifice 44. The flat lever 43 is positioned atop the roller 48. The second orifice 45 is disposed in the lever second end 43*b*.

Figure 5:
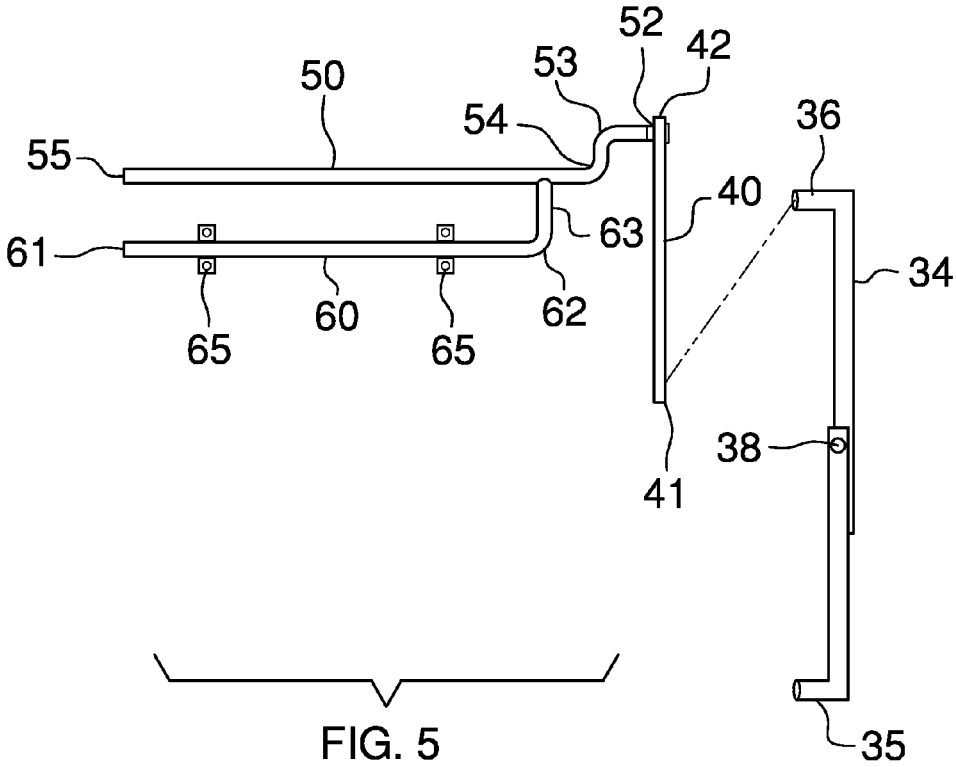
FIG. 5 is a front elevation view of the lift arm, hinge rod, seat arm, and the two-piece vertical arm.

Referring to FIG. 5, the most complete embodiment of the two-piece vertical arm 34 has a first arm bend 35 of about 90 degrees spaced apart from an opposite second arm bend 36 of about 90 degrees. The first arm bend 35 is pivotally disposed within the lever orifice 33. The set fastener 38 is selectively loosened and tightened in establishing a desired overall length of the two-piece vertical arm 34. The hinge rod 50 is pivotally disposed within an existing hinge 16 of an existing seat bottom 14. The hinge rod 50 has a rod first end 52 spaced apart from a rod second end 55. The hinge rod 50 has a rod second bend 54 disposed proximal to the existing hinge 16. The rod first bend 53 is disposed adjacent to the rod second bend 54. The rod second bend 54 is disposed adjacent to the rod second end 55. Both the rod first bend 53 and the rod second bend 54 are ideally each about 90 degrees. The lift arm 40 has a lift arm first end 41 spaced apart from the lift arm second end 42. The lift arm second end 42 is pivotally attached to the rod second end 55. The lift arm first end 41 is pivotally attached to the vertical arm 34 second arm bend 36.

Referring to FIGS. 5 and 7, the seat arm 60 has a bend extension 63 spaced apart from a seat arm second end 61. The bend extension 63 is affixed perpendicularly to the hinge rod 50 proximal to the rod second bend 54.

The bend extension 63 is connected to the seat arm 60 opposite the seat arm second end 61 via the seat arm bend 62 of about 90 degrees. The seat arm 60 is affixed to the existing seat bottom 14 via the pair of identical mount clamps 65.

Referring again to FIGS. 6 and 7, the base 20 is selectively placed upon an existing given surface next to an existing toilet 12. Downward pressure on the pedal 39 elevates the toilet seat bottom 14 by pivotally pushing up on lift arm first end 41. Upward release the pedal 39 lowers the toilet seat bottom 14 via gravity.

The terms medially and laterally refer to the position of the apparatus 10 aside an existing toilet 12. The positions of the lever 30 and flat lever 43, along with the pedestals and lever pedestals may therefore be reversed, given the desired positioning of the apparatus 10 next to a given toilet 12 side.

Figure 8:
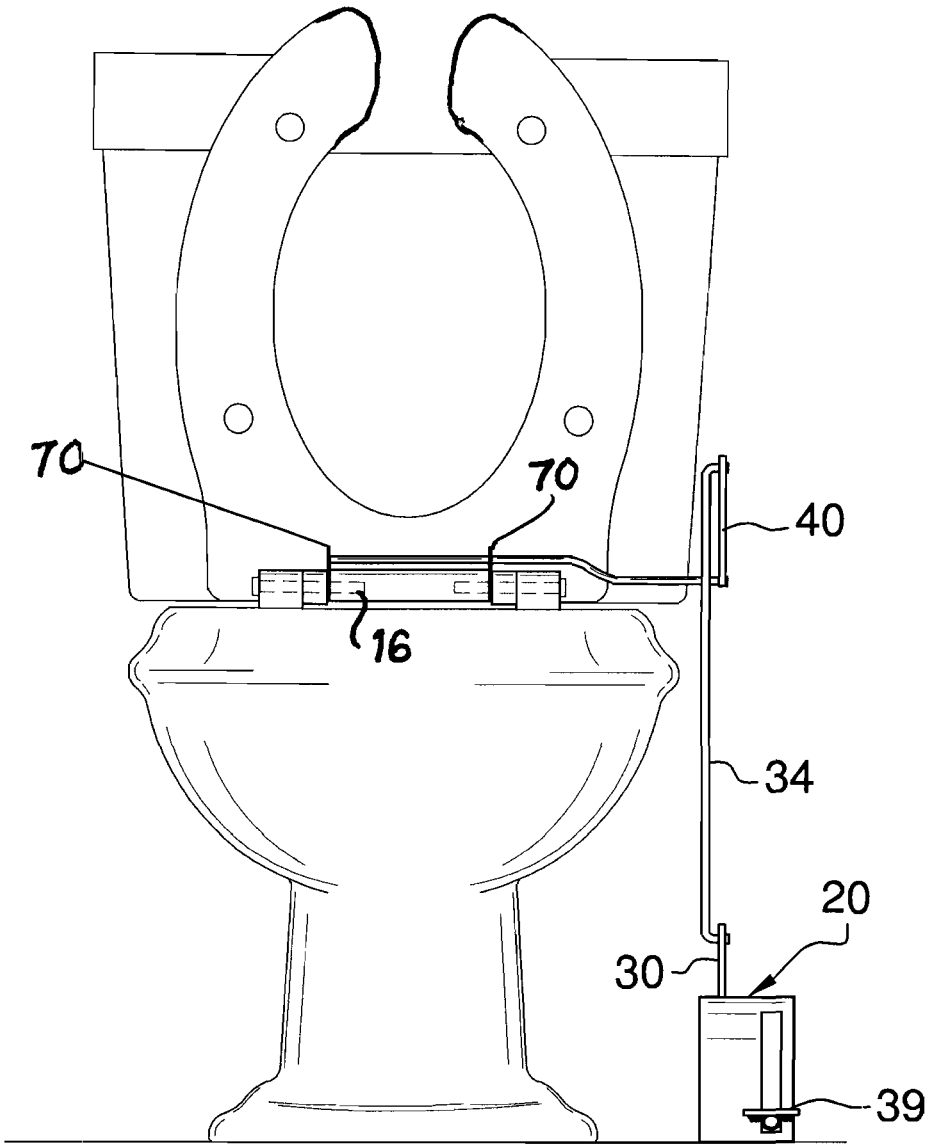
FIG. 8 is a front elevation view of the apparatus installed on an existing commercial toilet.

Referring to FIG. 8, the existing commercial toilet 12 has the apparatus 10 fitted to the existing hinges 16 via the pair of identical vertical hinge mounts 70 that are pivoted on the existing hinge 16. The hinge rod 50 of the apparatus 10 is thereby unneeded.

With respect to the above description then, it is to be realized that the optimum dimensional relationships for the parts of the toilet seat lifting apparatus, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the toilet seat lifting apparatus.

Directional terms such as "front", "back", "in", "out", "downward", "upper", "lower", and the like may have been used in the description. These terms are applicable to the embodiments shown and described in conjunction with the drawings.

These terms are merely used for the purpose of description in connection with the drawings and do not necessarily apply to the position in which the toilet seat lifting apparatus may be used.

Therefore, the foregoing is considered as illustrative only of the principles of the toilet seat lifting apparatus. Further, since numerous modifications and changes will readily occur to those skilled in the art, it is not desired to limit the toilet seat lifting apparatus to the exact construction and operation shown and described, and accordingly, all suitable modifications and equivalents may be resorted to, falling within the scope of the toilet seat lifting apparatus.

What is claimed is:

1. A toilet seat lifting apparatus, comprising, in combination:

a semicircular base having a base top disposed atop a base plate, the base plate placed upon an existing given surface next to an existing toilet;

a removable side cover disposed laterally on the base and removably connected to the base top;

a first slot disposed forwardly and laterally in the base top;

a second slot disposed rearwardly and medially in the base top;

a pair of identical spaced apart pedestals disposed forwardly and vertically atop the base plate, the pedestals comprising the first pedestal disposed parallel to the second pedestal;

a first pivot bolt with nut upwardly and horizontally connecting the first pedestal to the second pedestal;

a lever having a first end spaced apart from a second end, the lever movably fitted within the first slot, the lever pivotally connected to the first pivot bolt with nut between the first end and the second end;

a roller removably attached horizontally and medially to the lever second end;

a pair of spaced apart lever pedestals disposed vertically, medially and rearwardly on the base plate, the lever pedestals comprising the first level pedestal disposed parallel to the second lever pedestal;

a second pivot bolt with nut horizontally and upwardly connecting the first lever pedestal to the second lever pedestal;

a flat lever having a lever first end spaced apart from a lever second end, the lever first end pivotally connected to the second pivot bolt with nut via a first orifice, the flat lever positioned atop the roller;

a second orifice disposed in the lever second end;

a two-piece vertical arm having a first arm bend of about 90 degrees spaced apart from an opposite second end bend of about 90 degrees, the first arm bend pivotally disposed within the second lever orifice;

a set fastener selectively tightened in establishing a length of the two-piece vertical arm;

a hinge rod pivotally disposed within an existing hinge of an existing seat bottom, the hinge rod having a rod first end spaced apart from a rod second end, the hinge rod having a rod second bend of about 90 degrees proximal to the existing hinge, a rod first bend of about 90 degrees adjacent to the rod second bend, the rod second bend adjacent to the rod second end;

a seat arm having a bend extension spaced apart from a seat arm second end, the bend extension affixed perpendicularly to the hinge rod proximal to the rod second bend, the bend extension connected to the seat arm opposite the seat arm second end via a seat arm bend of about 90 degrees, the seat arm affixed to the existing seat bottom via a pair of identical mount clamps;

a lift arm having a lift arm first end spaced apart from a lift arm second end, the lift arm second end pivotally attached to the rod second end, the lift arm first end pivotally attached to the vertical arm second arm bend;

whereby a downward pressure on the pedal elevates the toilet seat bottom, and upward release of the pedal lowers the toilet seat bottom.

2. A toilet seat lifting apparatus, comprising, in combination:

a semicircular base having a base top disposed atop a base plate, the base plate placed upon an existing given surface next to an existing toilet;

a removable side cover disposed laterally on the base and removably connected to the base top;

a first slot disposed forwardly and laterally in the base top;

a second slot disposed rearwardly and medially in the base top;

a pair of identical spaced apart pedestals disposed forwardly and vertically atop the base plate, the pedestals comprising the first pedestal disposed parallel to the second pedestal;

a first pivot bolt with nut upwardly and horizontally connecting the first pedestal to the second pedestal;

a lever having a first end spaced apart from a second end, the lever movably fitted within the first slot;

a downward bend most proximal to the lever first end;

an upward bend most proximal to the lever second end, the lever pivotally connected to the first pivot bolt with nut between the downward bend and the upward bend;

a roller removably attached horizontally and medially to the lever second end;

a pair of spaced apart lever pedestals disposed vertically, medially and rearwardly on the base plate, the lever pedestals comprising the first level pedestal disposed parallel to the second lever pedestal;

a second pivot bolt with nut horizontally and upwardly connecting the first lever pedestal to the second lever pedestal;

a flat lever having a lever first end spaced apart from a lever second end, the lever first end pivotally connected to the second pivot bolt with nut via a first orifice, the flat lever positioned atop the roller;

a second orifice disposed in the lever second end;

a two-piece vertical arm having a first arm bend of about 90 degrees spaced apart from an opposite second end bend of about 90 degrees, the first arm bend pivotally disposed within the second lever orifice;

a set fastener selectively tightened in establishing a length of the two-piece vertical arm;

a hinge rod pivotally disposed within an existing hinge of an existing seat bottom, the hinge rod having a rod first end spaced apart from a rod second end, the hinge rod having a rod second bend of about 90 degrees proximal to the existing hinge, a rod first bend of about 90 degrees adjacent to the rod second bend, the rod second bend adjacent to the rod second end;

a seat arm having a bend extension spaced apart from a seat arm second end, the bend extension affixed perpendicularly to the hinge rod proximal to the rod second bend, the bend extension connected to the seat arm opposite the seat arm second end via a seat arm bend of about 90 degrees, the seat arm affixed to the existing seat bottom via a pair of identical mount clamps;

a lift arm having a lift arm first end spaced apart from a lift arm second end, the lift arm second end pivotally attached to the rod second end, the lift arm first end pivotally attached to the vertical arm second arm bend;

whereby a downward pressure on the pedal elevates the toilet seat bottom, and upward release of the pedal lowers the toilet seat bottom.

3. A toilet seat lifting apparatus, comprising, in combination:

a semicircular base having a base top disposed atop a base plate, the base plate placed upon an existing given surface next to an existing toilet;

a removable side cover disposed laterally on the base and removably connected to the base top;

a first slot disposed forwardly and laterally in the base top;

a second slot disposed rearwardly and medially in the base top;

a pair of identical spaced apart pedestals disposed forwardly and vertically atop the base plate, the pedestals comprising the first pedestal disposed parallel to the second pedestal;

a first pivot bolt with nut upwardly and horizontally connecting the first pedestal to the second pedestal;

a lever having a first end spaced apart from a second end, the lever movably fitted within the first slot;

a downward bend most proximal to the lever first end;

an upward bend most proximal to the lever second end, the lever pivotally connected to the first pivot bolt with nut between the downward bend and the upward bend;

a roller removably attached horizontally and medially to the lever second end;

a pair of spaced apart lever pedestals disposed vertically, medially and rearwardly on the base plate, the lever pedestals comprising the first level pedestal disposed parallel to the second lever pedestal;

a second pivot bolt with nut horizontally and upwardly connecting the first lever pedestal to the second lever pedestal;

a flat lever having a lever first end spaced apart from a lever second end, the lever first end pivotally connected to the second pivot bolt with nut via a first orifice, the flat lever positioned atop the roller;

a second orifice disposed in the lever second end;

a two-piece vertical arm having a first arm bend of about 90 degrees spaced apart from an opposite second end bend of about 90 degrees, the first arm bend pivotally disposed within the second lever orifice;

a set fastener selectively tightened in establishing a length of the two-piece vertical arm;

a seat arm having a bend extension spaced apart from a seat arm second end, the bend extension connected to the seat arm opposite the seat arm second end via a seat arm bend of about 90 degrees, the seat arm affixed to pair of spaced apart identical vertical hinge mounts that are pivoted on the existing hinges of the existing seat bottom;

a lift arm having a lift arm first end spaced apart from a lift arm second end, the lift arm second end pivotally attached to the rod second end, the lift arm first end pivotally attached to the vertical arm second arm bend;

whereby a downward pressure on the pedal elevates the toilet seat bottom, and upward release of the pedal lowers the toilet seat bottom.

* * * * *